US008251746B2

(12) United States Patent
Zhang et al.

(10) Patent No.: US 8,251,746 B2
(45) Date of Patent: Aug. 28, 2012

(54) SHIELDED ELECTRICAL CONNECTOR

(75) Inventors: George Huanyi Zhang, Irvine, CA (US); An-Jen Yang, Irvine, CA (US); Gustavo F Duenas, Placentia, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 170 days.

(21) Appl. No.: 12/861,131

(22) Filed: Aug. 23, 2010

(65) Prior Publication Data

US 2012/0045935 A1 Feb. 23, 2012

(51) Int. Cl.
*H01R 13/648* (2006.01)

(52) U.S. Cl. ..... 439/607.11; 439/660

(58) Field of Classification Search ..... 439/607.11, 439/607.05, 607.08, 607.1, 607.13, 607.24, 439/607.4, 660

See application file for complete search history.

(56) References Cited

U.S. PATENT DOCUMENTS 5,342,220 A * 8/1994 Kodama ..... 439/607.4
6,074,225 A * 6/2000 Wu et al. ..... 439/101
7,179,127 B2 * 2/2007 Shiu ..... 439/607.35

* cited by examiner

*Primary Examiner* — Phuong Dinh
(74) *Attorney, Agent, or Firm* — Wei Te Chung; Andrew C. Cheng; Ming Chieh Chang

(57) ABSTRACT

An electrical connector includes a shielding cage, an insulative housing disposed within the shielding cage, at least two rows of terminals secured in the insulative housing and a metal sheet embedded in the insulative housing and disposed between the rows of terminals. An insulative housing defines a mating face and a mounting face perpendicular to the mating face. The metal sheet extends from the mating face to the mounting face and comprises at least one tail extending beyond the mounting face.

7 Claims, 9 Drawing Sheets

SHIELDED ELECTRICAL CONNECTOR

BACKGROUND OF THE INVENTION

1. Field of the Invention

The present invention relates generally to electrical connector, and more particularly to a shielded electrical connector having a metal sheet.

2. Description of Related Art

A shielded electrical connector is provided having several rows of contacts inside the housing and outer metallic shell for the purpose of shielding. Such shielded electrical connectors are widely used in computers, work stations and other types of electronic office equipment for the connection of signal-carrying lines. In such shielded electrical connectors, the metal shell prevents electromagnetic noise from penetrating into the connector, but it does not eliminate the problem related to cross-talk between contact pins.

Hence, it is desired to provide an electrical connector to overcome the problems mentioned above.

BRIEF SUMMARY OF THE INVENTION

An electrical connector comprises a shielding cage, an insulative housing disposed within the shielding cage, at least two rows of terminals secured in the insulative housing and a metal sheet embedded in the insulative housing and disposed between the rows of terminals. An insulative housing defines a mating face and a mounting face perpendicular to the mating face. The metal sheet extends from the mating face to the mounting face and comprises at least one tail extending beyond the mounting face.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
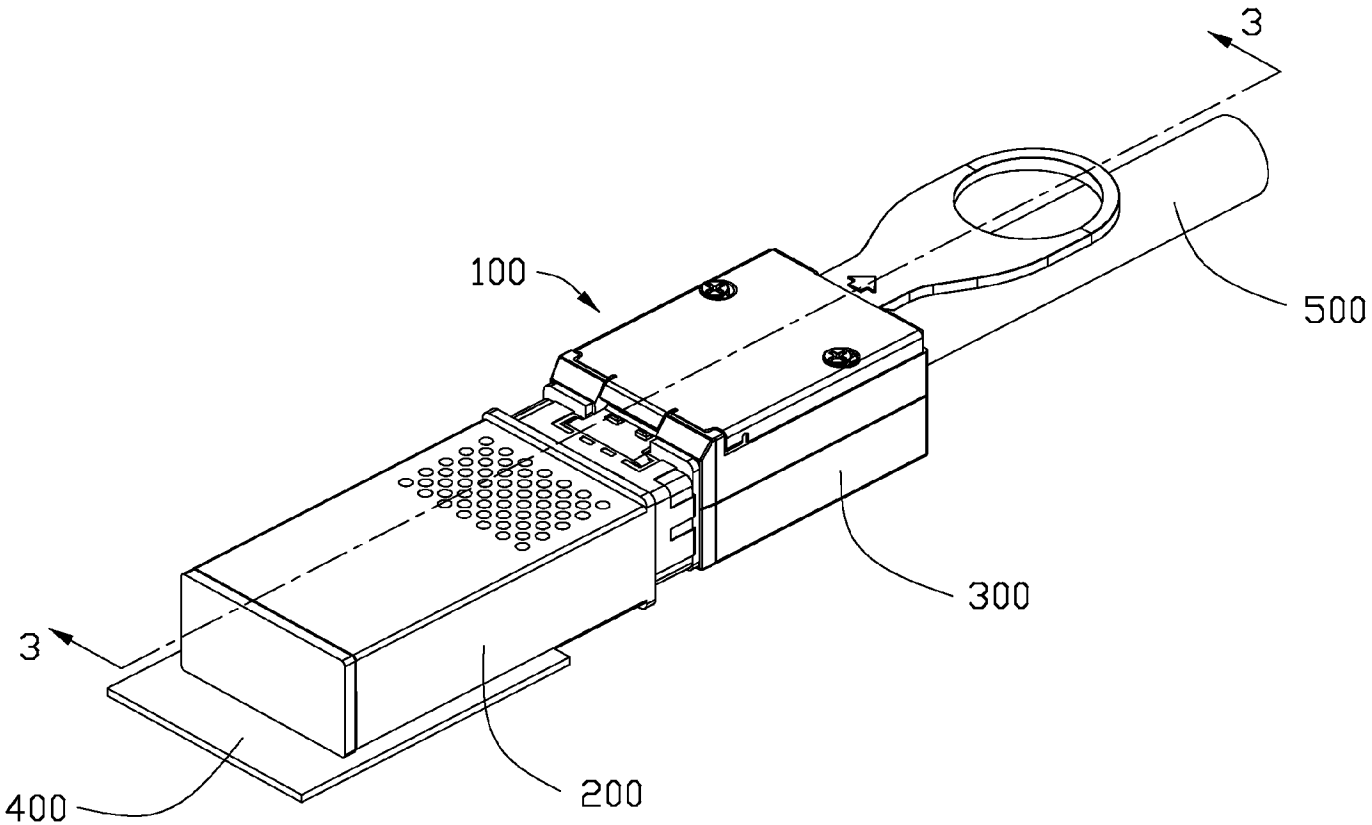
FIG. 1 is a perspective view of an electrical connector assembly according to the present invention.

Reference will be made to the drawing figures to describe the present invention in detail, wherein depicted elements are not necessarily shown to scale and wherein like of similar elements are designated by same or similar reference numeral through the several views and same or similar terminology.

Figure 2:
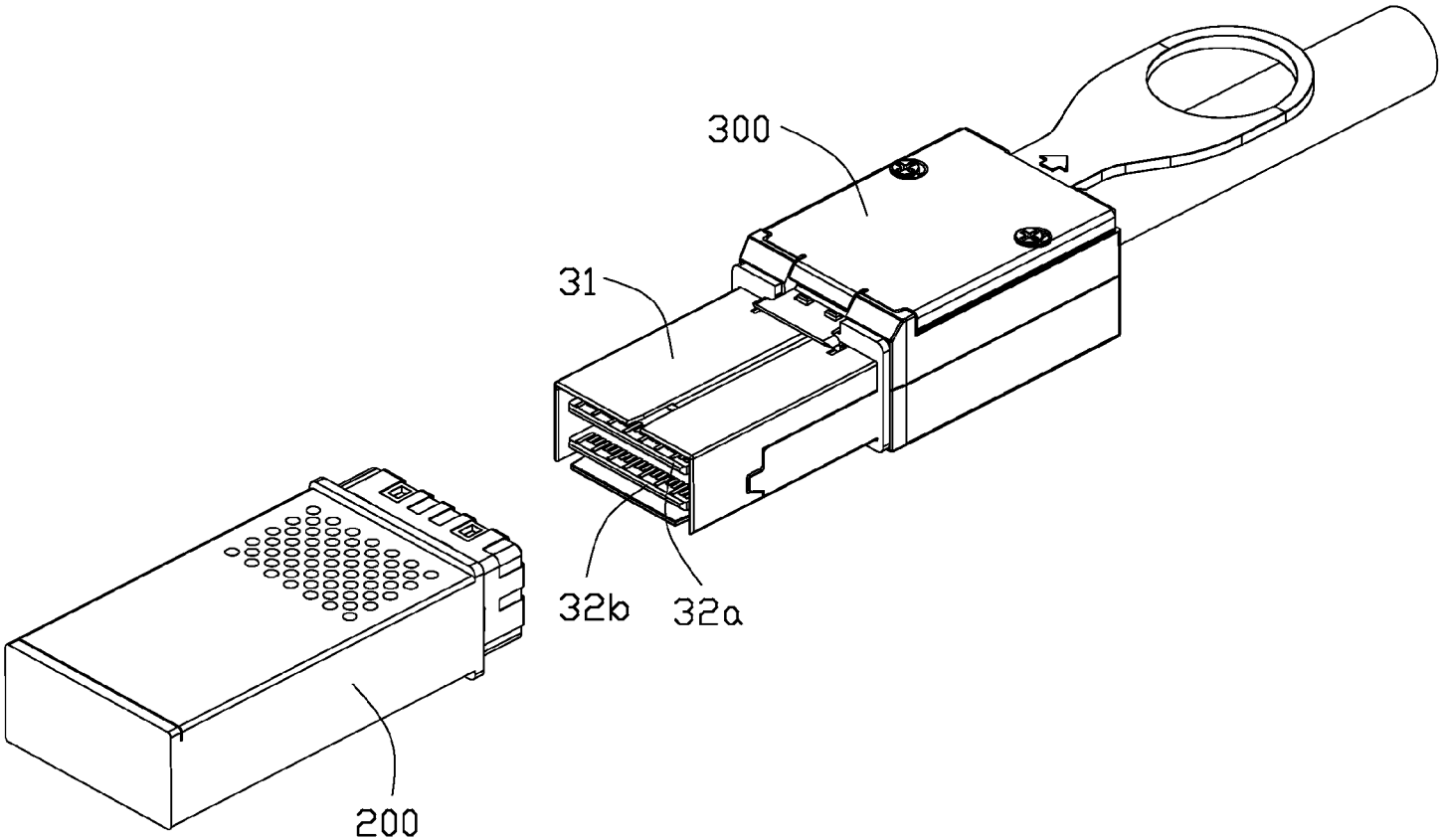
FIG. 2 is an exploded view of the electrical connector assembly shown in FIG. 1.

Referring to FIGS. 1-2, an electrical connector assembly 100 according to a preferred embodiment of the present invention comprises a first electrical connector 200 and a second electrical connector 300. The first electrical connector 200 is electrically connected to a printed circuit board (PCB) 400, and the second electrical connector 300 is electrically coupled to a cable 500.

Figure 4:
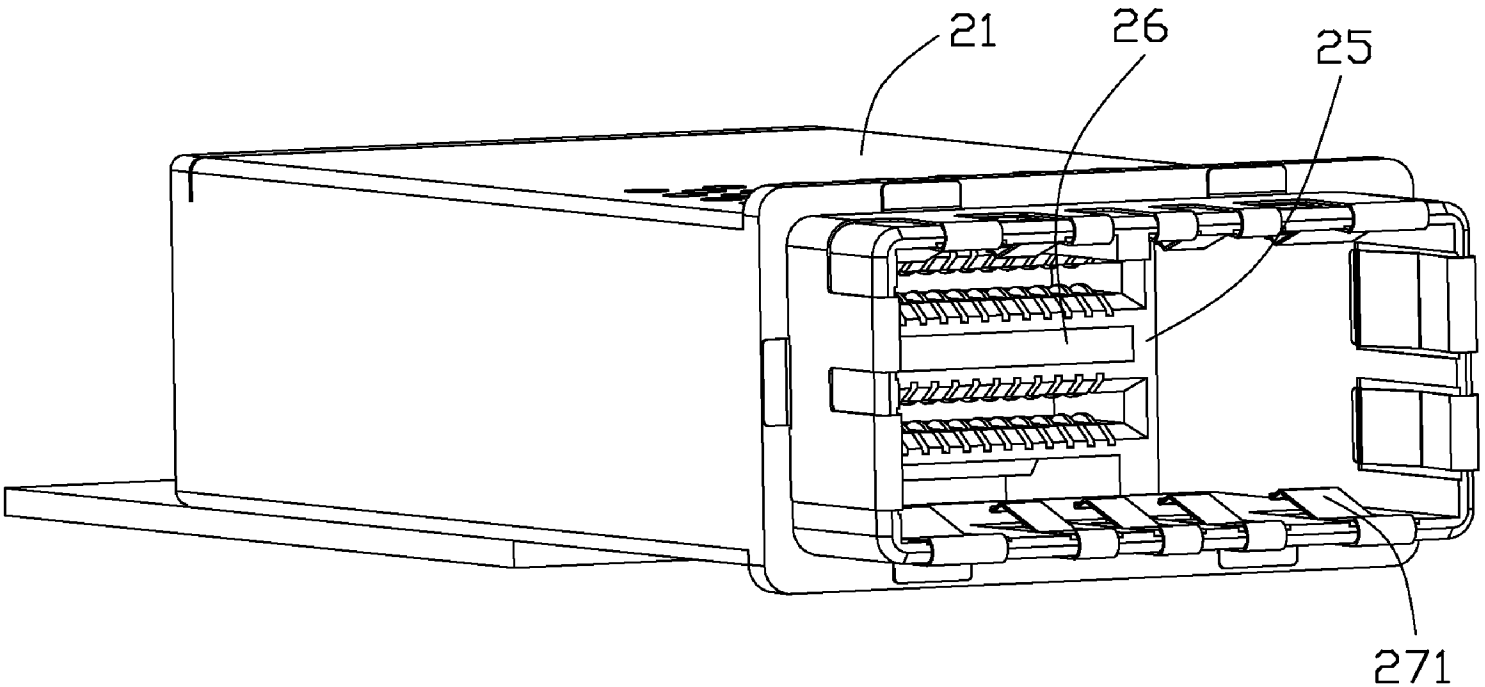
FIG. 4 is a perspective view of the first electrical connector shown in FIG. 1.
Figure 5:
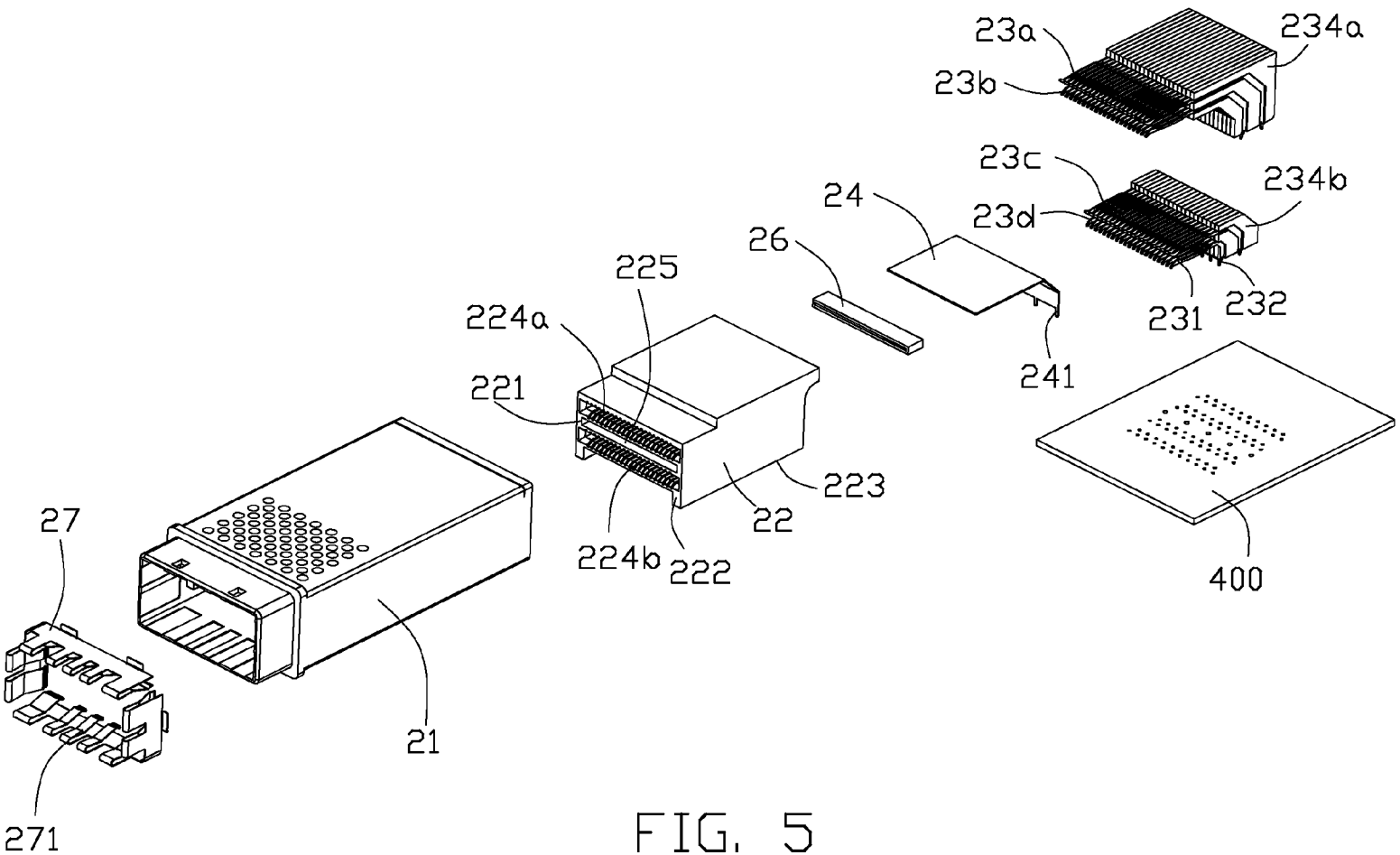
FIG. 5 is a cross-section view of the first electrical connector shown in FIG. 4.

Referring to FIGS. 4-5, the first electrical connector 200 mounted on the PCB 400 includes a shielding cage 21, an insulative housing 22 disposed within the shielding cage 21 and four rows of terminals 23*a*, 23*b*, 23*c*, 23*d* secured in the insulative housing 22 from upper to lower. Terminals 23*a*, 23*b* of the first and second rows are arranged in one upper terminal block 234*a* and terminals 23*c*, 23*d* of the third and forth rows are arranged in one lower terminal block 234*b*, said two terminal blocks are separated from each other. The contacting portions 231 of the terminals are in the form of cantilever and the tail portions 232 are embedded in insulating seat to form said terminal blocks. The insulative housing 22 defines a mating face 222 and a mounting face 223 perpendicular to the mating face 222. Two parallel mating slots 224*a*, 224*b* run through the mating face 222 and are separated by an the internal partition 221. Combination with FIG. 6, the terminals 23 are inserted in the housing 22, the contacting portions 231 of the first and second rows 23*a*, 23*b* expose to the upper slot 224*a*, the contacting portions 231 of the third and forth rows 23*c*, 23*d* expose to the lower slot 224*b*. The tail portions 232 extend rearward and downwardly to the mounting face 223 so as to be soldered to corresponding through holes of the PCB 400.

Figure 6:
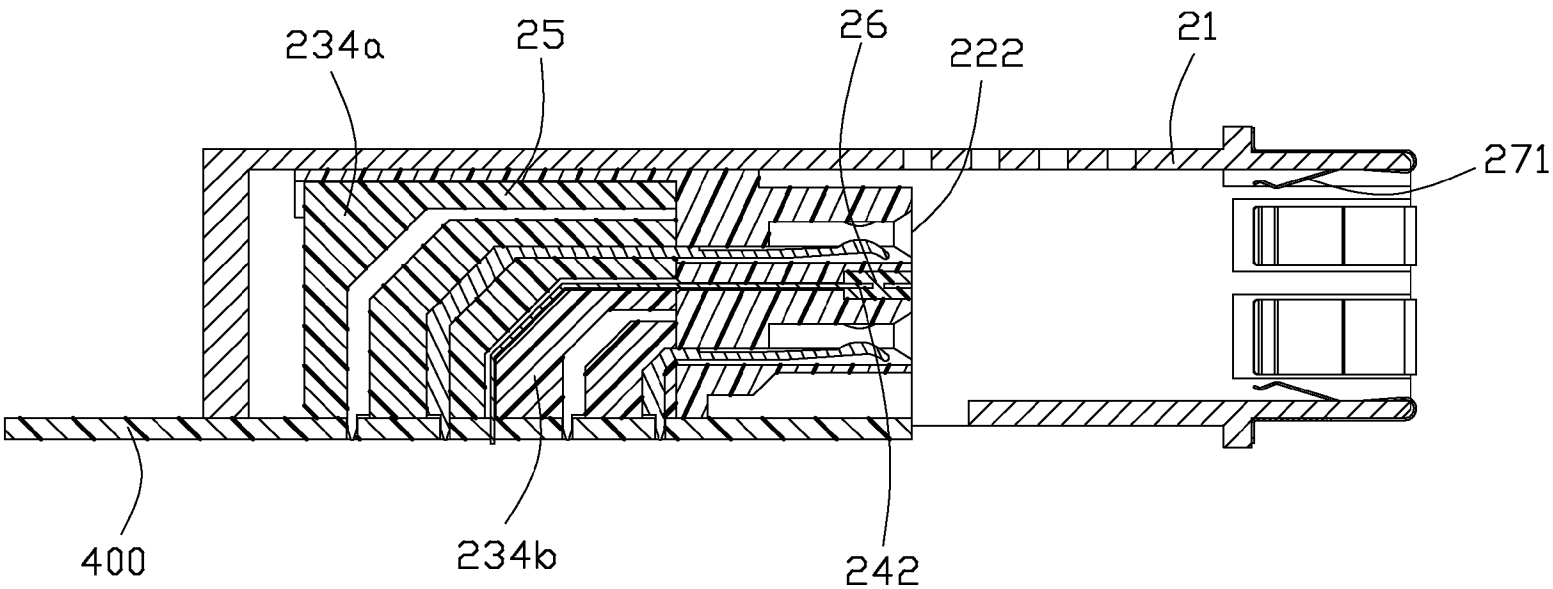
FIG. 6 is an exploded view of the first electrical connector shown in FIG. 4.

The internal partition 221 defines a receiving slot 225 at front edge thereof and opening forwards. The metal sheet 24 comprises a plurality of tails 241 at a bottom edge thereof. The metal sheet 24 has a cross section similar to the terminal 23. As shown in FIG. 6, the metal sheet 24 is embedded in the housing 22 between said two terminal blocks 234*a*, 234*b* with the front end 242 exposing to the receiving slot 225 and the tails 241 extending beyond the mounting face 223 of the insulative housing 22. A conductive gasket 26 is received in the receiving slot 225 and is electrically connected with the front end 242 of the metal sheet 24. The tails 241 are similar to the tail portions 232 of terminals and are adapted to electrically contact a grounding circuit of the PCB 400, thus preventing cross-talk between the two upper rows 23*a* and 23*b*, and the two lower rows 23*c*, 23*d*.

The insulative housing 22 embedded with the terminal block form a connector body 25 which is seated in a rear end of the metallic shell 21 as best shown in FIG. 6. Two spring members 27 are formed with inwards-bending spring fingers 271. As shown in FIG. 4, the spring members 27 clip front edges of the shielding cage 21 and the fingers 271 extend rearward to the inner of shielding cage 21.

Figure 3:
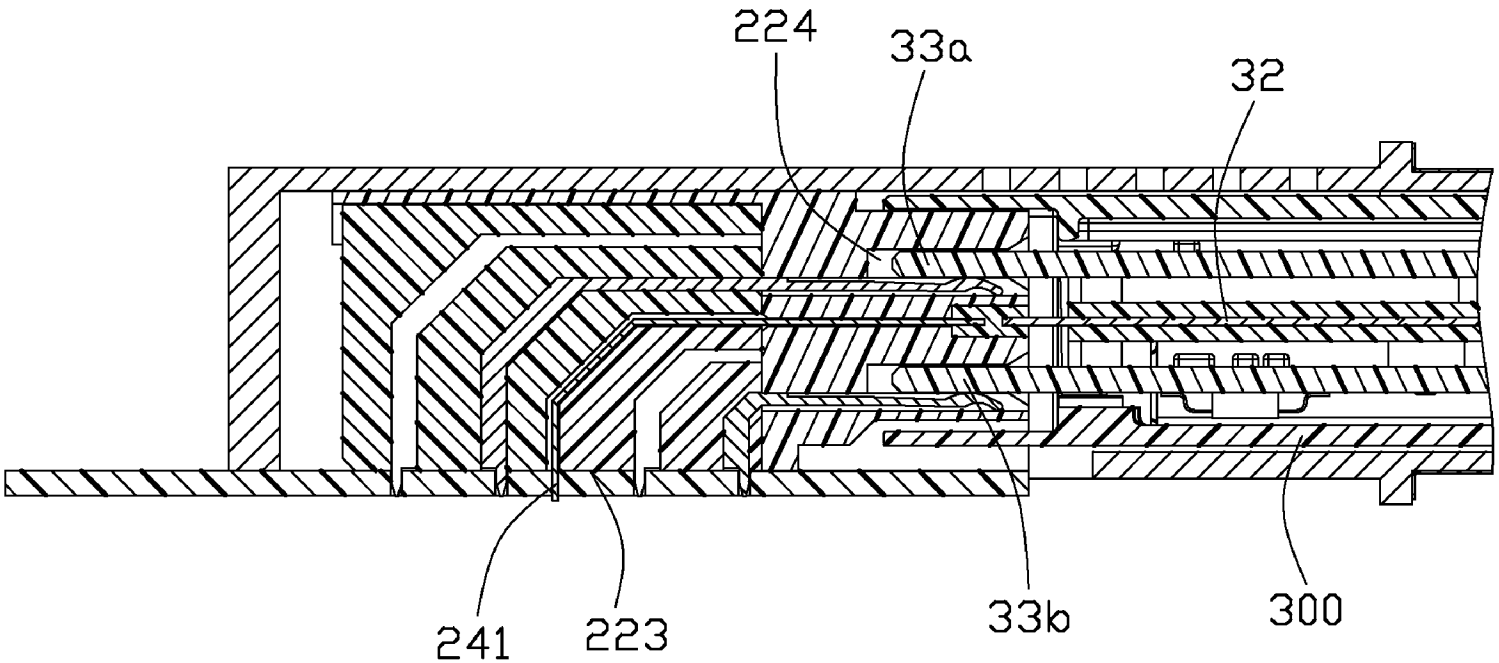
FIG. 3 is a cross-section view of the electrical connector assembly.

As shown in FIGS. 2 and 3, the second electrical connector 300 is adapted to be coupled to the first connector 200 and which comprises two spaced mating boards 33*a*, 33*b* disposed in a metallic shell 31. A metal sheet 32 are embedded in the housing thereof, which is parallel to the mating boards 33*a*, 33*b* but shorter than the mating board 33*a*, 33*b* as best shown in FIG. 3.

FIG. 3 shows an engagement of said two connectors. The first and second electrical connectors 200, 300 are matable to each other wherein the mating boards 33*a*, 33*b* are inserted into the slots 224 to contact the contacting portions of the terminals. The mating board 33*a* forms an electrical connection with the respective terminals 23*a*, 23*b* and the mating board 33*b* forms an electrical connection with the respective terminals 23*c*, 23*d*. The metal sheet 34 is inserted in the conductive gasket 26, thereby said two metal sheets are conductive through the conductive gasket 26.

The metal sheet 24 of the first connector 200 and the metal sheet 34 of the second connector 300 form an electrical connection, thus preventing cross-talk between terminals 23*a*, 23*b* of the upper terminal block 234*a* and terminals 23*c*, 23*d* of the lower terminal block 234*b*. The electrical connection between the metal sheet 24 of the first connector 200 and the metal sheet 34 of the second connector 300 is formed through the conductive gasket 26.

Figure 7:
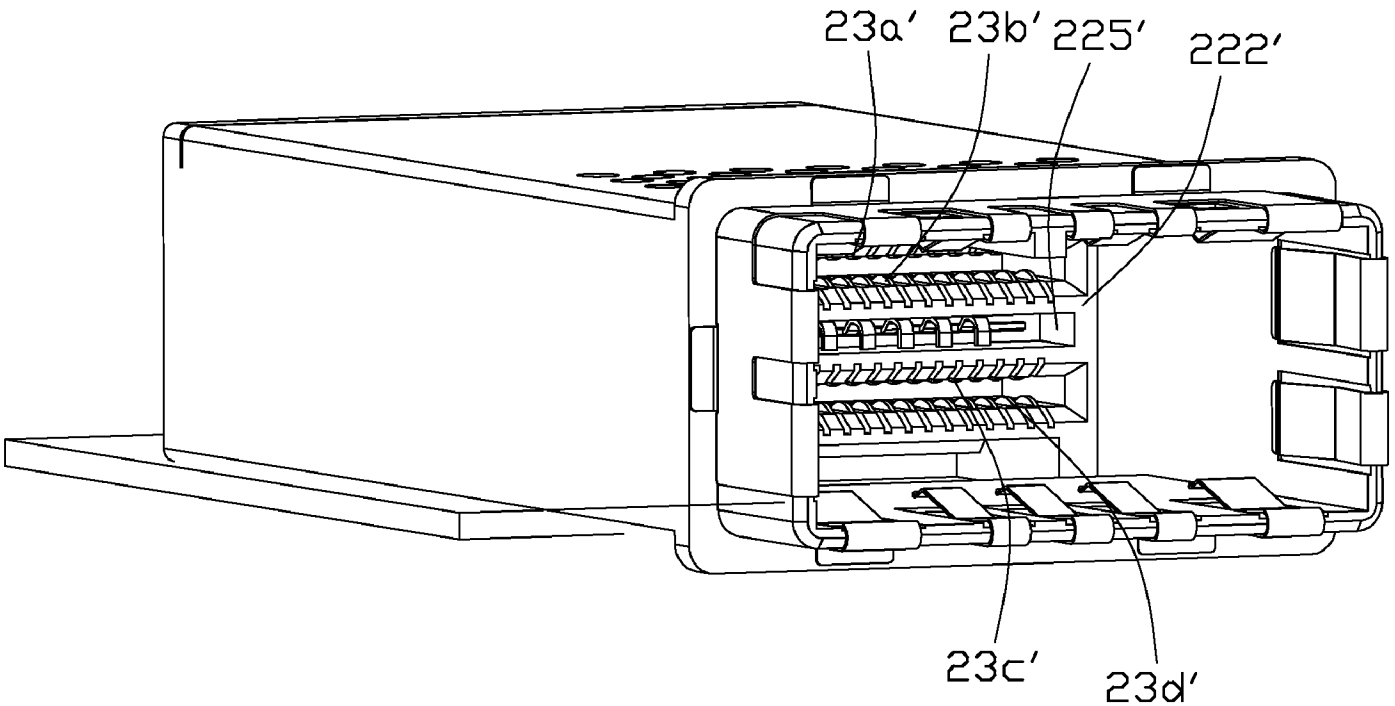
FIG. 7 is a perspective view of the first electrical connector shown according to the second embodiment.
Figure 8:
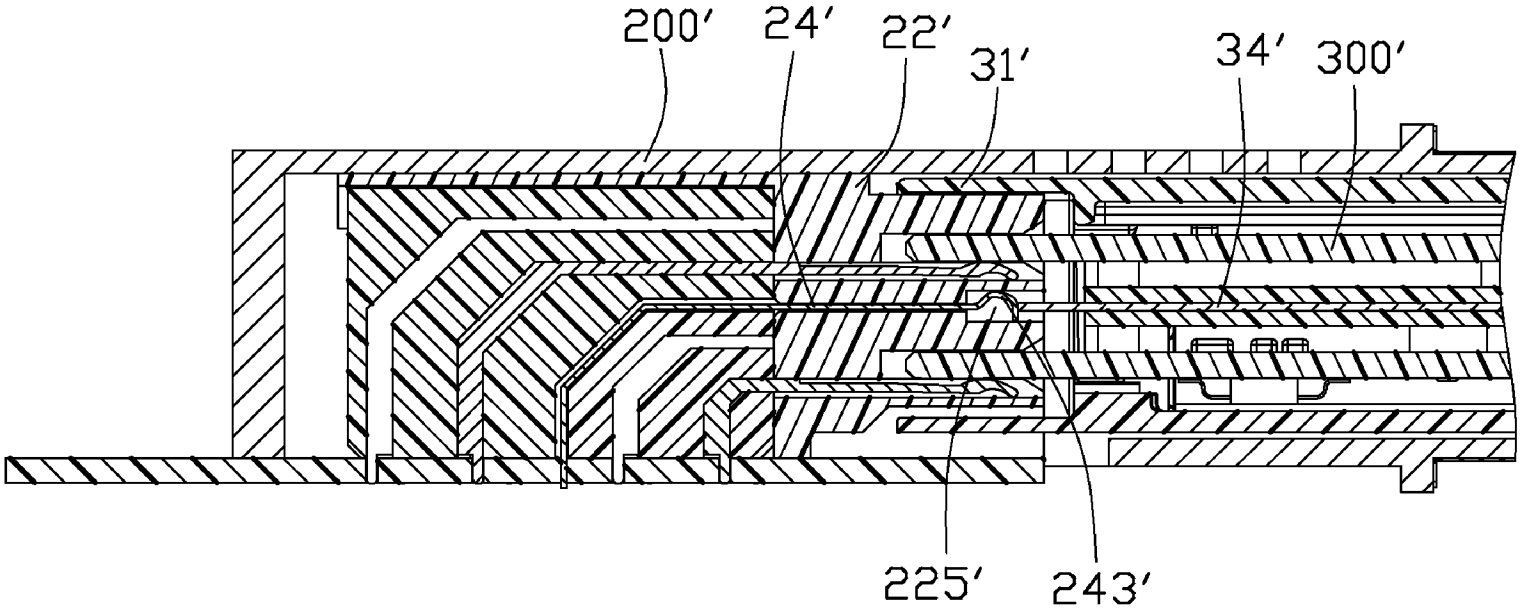
FIG. 8 is a cross-section view of the first electrical connector mated with a second electrical connector.
Figure 9:
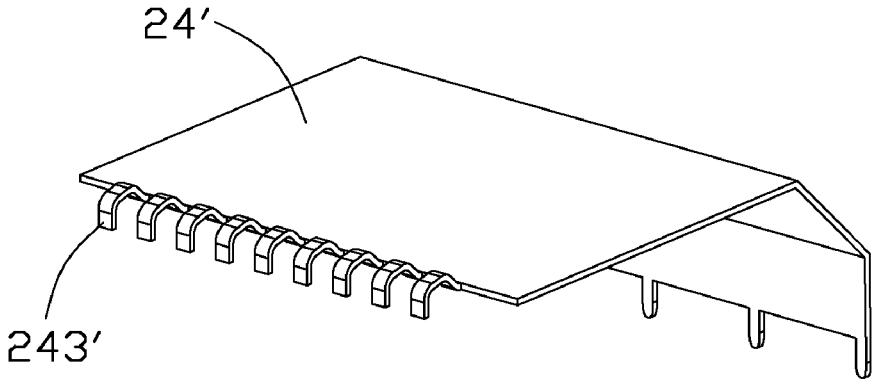
FIG. 9 is a perspective view of a metal sheet shown in FIG. 7.

Referring to FIGS. 7-9, a second embodiment is provided of the present invention. An electrical connector 200' is similar to the first electrical connector 200 of the first embodiment and the difference between them is that a metal sheet 24' of the electrical connector 200' has a plurality of resilient fingers 243' exposing in a receiving slot 225' formed in the mating face 222' of the insulative housing 22'. When the first electrical connector 200' and a second electrical connector 300' are mated together, the resilient finger 243' of the first electrical connector 200' elastically engage with a metal sheet 34' of the second electrical connector 300'. Therefore, an electrical connection is formed between the metal sheet 24' and the metal sheet 34', thus preventing cross-talk between terminals 23*a*', 23*b*' of upper terminal block and terminals 23*c*', 23*d*' of lower terminal block.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector assembly, comprising:

a first electrical connector having an insulative housing disposed within a shielding cage and at least two rows of terminals secured in the insulative housing, the housing defining a mating face and a mounting face perpendicular to the mating face, the insulative housings includes a metal sheet disposed between the rows of terminals, the metal sheet extending form the mating face to the mounting face and comprising at least one tail extending beyond the mounting face; and a second electrical connector having at least two mating boards within a metallic shell, a metal sheet disposed between the two mating boards, the first and second electrical connectors being matable to each other;

wherein the metal sheet of the first connector is electrically connected with the metal sheet of the second connector when the first and second electrical connectors mate with each other.

2. The electrical connector assembly as claimed in claim 1, wherein a conductive gasket is received in a receiving slot formed in the mating face of the insulative housing and is electrically connected with the metal sheet.

3. The electrical connector assembly as claimed in claim 1, wherein the metal sheet further comprises at least one resilient portion received in a receiving slot formed in the mating face of the insulative housing.

4. An electrical connector assembly comprising:

a first connector mounted upon a printed circuit board and including an insulative housing defining upper and lower mating slots with a first divider therebetween;

a first metallic shielding plate embedded within the first divider;

a receiving slot formed in a front end of the first divider in parallel with the upper and lower mating slots;

a plurality of first contacts disposed in the housing and extending into the upper and lower mating slots;

a second connector linked by a cable and including a pair of mating circuit boards respectively mated into the corresponding upper and lower mating slots;

a second divider located between the pair of mating circuit boards;

a second metallic shielding plate embedded within the second divider; wherein a front end of the second metallic shielding plate extends forwardly beyond the second divider and into the receiving slot for electrically connecting to the first metallic shield plate.

5. The electrical connector assembly as claimed in claim 4, wherein the front end of the second metallic shielding plate directly mechanically and electrically connects to the first metallic shielding plate.

6. The electrical connector assembly as claimed in claim 4, wherein a conductive gasket is fitted within the receiving slot, and said front end of the second metallic shielding plate is electrically connected to the second metallic shielding plate via said conductive gasket.

7. The electrical connector assembly as claimed in claim 4, wherein said first metallic shielding plate is directly mechanically and electrically connected to the printed circuit board.

* * * * *